US006121584A

United States Patent [19]

Key et al.

[11] Patent Number: 6,121,584

[45] Date of Patent: Sep. 19, 2000

[54] HIDDEN BAKE OVEN FALSE BOTTOM

[75] Inventors: Johnny Douglas Key, Ringgold; Jackie Jerome Whitlock, Chickamauga, both of Ga.

[73] Assignee: General Electric Company, Louisville, Ky.

[21] Appl. No.: 09/372,255

[22] Filed: Aug. 11, 1999

[51] Int. Cl.[7] ..... A21B 1/14; A21B 1/50; A21B 3/00

[52] U.S. Cl. ..... 219/407

[58] Field of Search ..... 219/391, 392, 219/407; 126/22, 332, 337 R, 339; 432/250

[56] References Cited

U.S. PATENT DOCUMENTS

| | | | |
|---|---|---|---|
| 1,620,602 | 3/1927 | Mayer | 219/407 |
| 2,035,757 | 3/1936 | Ottenstein | 219/407 |
| 4,476,848 | 10/1984 | Protas | 126/337 R |
| 4,640,265 | 2/1987 | Romo | 126/337 R |
| 4,757,181 | 7/1988 | Sakamoto et al. | 219/391 |
| 5,272,317 | 12/1993 | Ryu | 219/392 |
| 5,618,458 | 4/1997 | Thomas | 126/337 R |
| 5,938,968 | 8/1999 | Ogg et al. | 126/339 |

*Primary Examiner*—Joseph Pelham
*Attorney, Agent, or Firm*—H. Neil Houser

[57] ABSTRACT

A false bottom for an oven having a bake element inside an oven chamber covers the bake element and provides an easy-to-clean surface above the bake element. The false bottom is removable to further facilitate cleaning of the false bottom, as well as allowing access to the bake element from the front of the oven for cleaning and repair.

20 Claims, 2 Drawing Sheets

HIDDEN BAKE OVEN FALSE BOTTOM

BACKGROUND OF THE INVENTION

This invention relates generally to ovens and, more particularly, to ovens with a bake element positioned inside an oven chamber.

Bake ovens conventionally include a bake element positioned in the lower portion of an oven chamber, typically just above the oven chamber floor, to generate heat inside the oven chamber. Often, however, during use of such ovens, food, and cooking juices are spilled or splattered inside the oven chamber, ultimately coating the bake element and the chamber floor with greasy cooking byproducts and residue. Thus, it is periodically necessary to clean the oven chamber floor. The proximity of the bake element and the oven chamber floor, however, complicates this task and greatly increases the required time to complete it.

To facilitate cleaning of an oven chamber floor, bake elements have been placed underneath the oven chamber floor. Thus, a smooth oven chamber floor results which is much easier to clean while at the same time rendering the oven more aesthetically appealing. Servicing the bake elements of these types of ovens, however, is made more difficult because the bake element is not accessible from the front of the oven. Rather, the oven must be pulled out from a wall to access the bake element in a restricted manner from the rear of the oven.

Accordingly, it would be desirable to provide an oven assembly that allows for easy cleaning of an oven and easy access to the bake element for service and repair.

BRIEF SUMMARY OF THE INVENTION

In an exemplary embodiment of the invention, a false bottom for an oven includes a surface configured for removable insertion into an oven chamber so that an oven bake element is positioned between an oven chamber floor and the surface of the false bottom. The false bottom surface covers the oven chamber floor and the bake element and provides a smooth, false oven floor above the bake element that is easily cleaned.

The false bottom is removable so that the bake element may be accessed from the front of the oven simply by removing the false bottom. Also, the false bottom can be removed from the oven for cleaning in a more convenient location than inside the oven chamber. Finally, the aesthetic appeal of the oven is improved as the burner is covered by the false bottom.

Thus, the above-described oven false bottom provides an aesthetically appealing hidden bake oven having a distinct cleaning advantage while providing easy access to the bake element for service and repair.

DETAILED DESCRIPTION OF THE INVENTION

Figure 1:
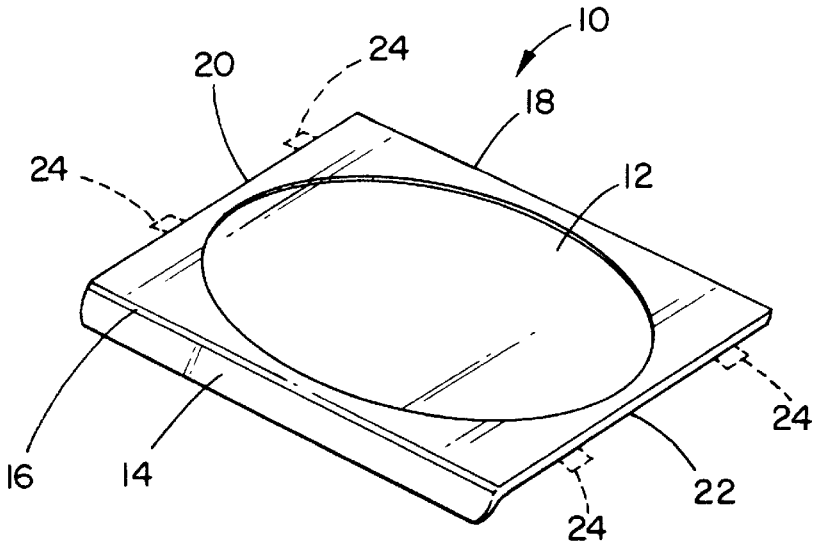
FIG. 1 is a perspective view of a false oven bottom.

FIG. 1 is a perspective view of an oven false bottom 10 including a top surface 12 and a front lip 14 extending at an angle from top surface 12 along a front edge 16 of top surface 12. Top surface 12 extends between front edge 16 and a back edge 18, and between a left edge 20 and a right edge 22. In one particular embodiment top surface 12 is substantially flat to minimize cleaning difficulty of top surface 12. In alternative embodiments, top surface 12 could have many other configurations, such as, for example, a ribbed surface or a curved surface.

False bottom 10 is fabricated from cold rolled steel dipped in porcelain and is dimensioned to be installed into an oven chamber (not shown in FIG. 1). Also, false bottom 10 is configured with a smooth left edge 20 and a smooth right edge 22 to facilitate sliding insertion of false bottom 10 into the oven chamber. In alternative embodiments, false bottom 10 includes projections 24 (shown in phantom) that engage complementary recesses (not shown) in a sidewall of oven chamber, and/or other mounting configurations known in the art to removably fasten false bottom 10 to the oven chamber.

Figure 2:
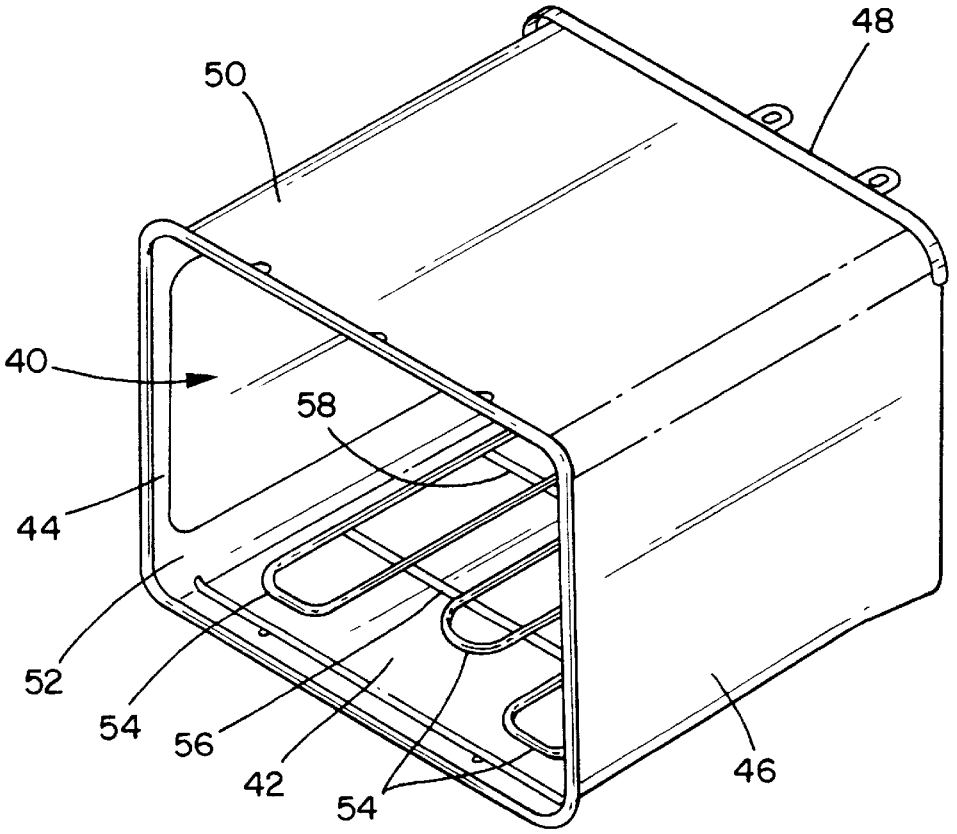
FIG. 2 is a perspective view of an oven chamber.
Figure 3:
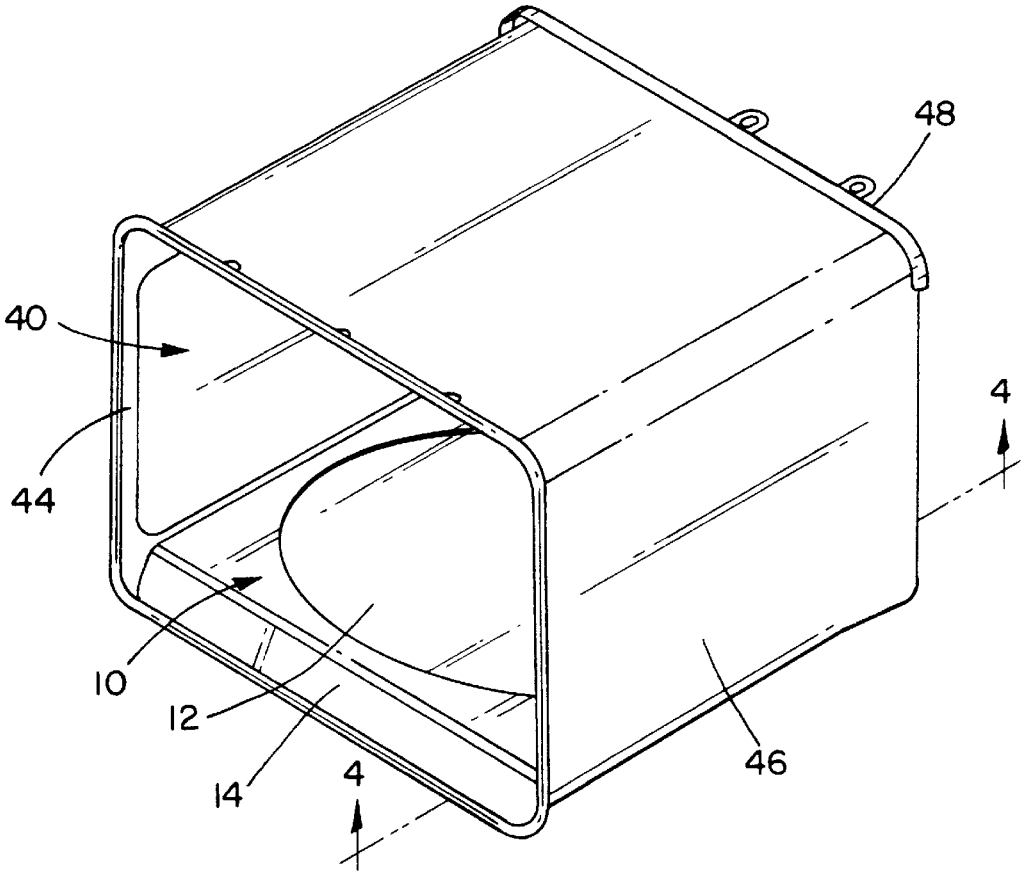
FIG. 3 is a perspective view of the false bottom shown in FIG. 1 installed in the oven chamber shown in FIG. 2.

FIG. 2 is a perspective view of an oven chamber 40 including a chamber floor 42, a plurality of chamber sidewalls 44, 46, 48, a chamber ceiling 50 and a front face 52 that is opened or closed with an oven door (not shown) to gain access to oven chamber 40. A bake element 54 is positioned above oven chamber floor 42 and is held in place with a first bracket 56 and a second bracket 58. The use of oven false bottom 10 is not restricted to any particular oven chamber or bake element, the construction and operation of which are well known in the art FIG. 3 illustrates oven chamber 40 with oven false bottom 10 installed to form a hidden bake oven (not shown). False bottom 10 covers and conceals oven chamber floor 42 (FIG. 2) and bake element 54 (FIG. 2), thereby providing a smooth, flat false bottom top surface 12 that is easier to clean than oven chamber floor 42 around bake element 54 (FIG. 2). False bottom top surface 12 extends from oven chamber sidewall 44 to oven chamber sidewall 46, and from rear oven chamber sidewall 48 to false bottom front lip 14. Front lip 14 extends from false bottom top surface 12 toward oven chamber floor 42 to form a smooth transition to the false bottom top surface 12.

In one particular embodiment, false bottom 10 is slidably inserted into oven chamber 40 with false bottom edges 18, 20, 22 sliding in grooves (not shown) in oven chamber sidewalls 44, 46, 48. In an alternative embodiment, false bottom 10 could be configured with rollers (not shown) engaging rails (not shown) attached to oven chamber sidewalls 44, 46 for sliding movement of false bottom. In a further alternative embodiment, false bottom 10 is snap fitted to the inside of oven chamber 40. In yet another alternative embodiment, removable fasteners (not shown) known in the art are used to removably attach false bottom 10 to oven chamber 40. Further still, and in an alternative embodiment, false bottom 10 is self supported and simply rests on oven chamber floor 42 with top surface 12 extending above bake element 54.

Figure 4:
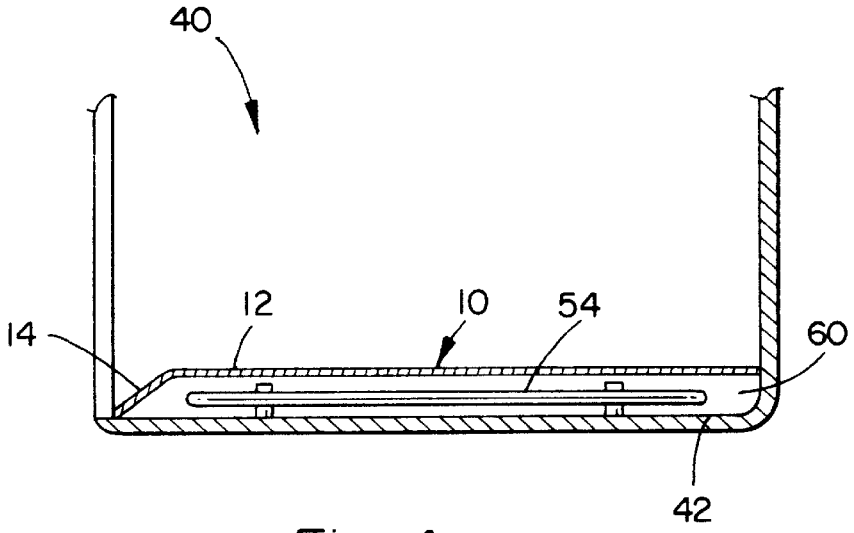
FIG. 4 is a partial cross sectional view taken along line 4—4 of FIG. 3.

FIG. 4 is a partial cross sectional view of FIG. 3. False bottom 10 is installed in oven chamber 40 above both oven chamber floor 42 and bake element 54 to form a cavity 60 between false bottom 10 and oven chamber floor 42 that contains bake element 54. False bottom front lip 14 extends from false bottom top surface 12 to oven chamber floor 42 and closes cavity 60.

After oven chamber 40 and bake element 54 have been constructed and connected, false bottom 10 is installed into oven chamber 40 to cover bake element 54 and substantially the entire oven chamber floor 42. False bottom 10 may be installed by either sliding false bottom 42 into oven chamber 40 or inserting false bottom 10 into oven chamber 40. If desired, false bottom 10 is then fastened to oven chamber 40.

Therefore, false bottom top surface 12 can be cleaned relatively easily and protects bake element 54 from corrosion due to cooking residue. Moreover, false bottom 10 may be removed to facilitate cleaning and provide convenient access to bake element 54 from the front of an oven (not shown) through oven chamber front face 52 (FIGS. 2 and 3) for service and repair. Therefore, a hidden bake oven is realized with the above-described false bottom that improves the aesthetics of an oven, renders an oven easier to clean, and allows convenient access to a bake element for service and repair.

While the invention has been described in terms of various specific embodiments, those skilled in the art will recognize that the invention can be practiced with modification within the spirit and scope of the claims.

What is claimed is:

1. A false bottom for an oven having an oven chamber and a bake element within the chamber, said false bottom comprising:

a surface configured for removable insertion into the oven chamber so that the bake is positioned between the oven chamber floor and said surface, said surface covering the oven chamber floor.

2. A false bottom in accordance with claim 1 wherein said surface is flat.

3. A false bottom in accord with claim 1 further comprising a lip extending from said surface toward said oven chamber floor when said surface is inserted into the oven.

4. A false bottom in accordance with claim 1 wherein the oven chamber includes sidewalls, said surface contacting the sidewalls when inserted into the oven chamber.

5. A false bottom in accordance with claim 4 wherein said surface forms a cavity that contains the bake element.

6. A false bottom in accordance with claim 4 wherein said surface is configured for slidable insertion into the oven chamber.

7. A false bottom in accordance with claim 4 wherein said surface is configured for fastening to the oven chamber.

8. A false bottom in accordance with claim 7 wherein said surface conceals the bake element from view when said surface is inserted into the oven chamber.

9. A false bottom in accordance with claim 1 wherein said surface is self supporting above the bake element when inserted into the oven chamber.

10. A hidden bake oven comprising:

an oven chamber comprising an oven chamber floor;

a removable false bottom positioned above said oven chamber floor; and a bake element positioned between said oven chamber and said false bottom.

11. A hidden bake oven in accordance with claim 10 wherein said removable false bottom is positioned substantially parallel to said chamber floor.

12. A hidden bake oven in accordance with claim 10 wherein said false bottom covers said bake element.

13. A hidden bake oven in accordance with claim 10 wherein said false 10 bottom is substantially flat.

14. A hidden bake oven in accordance with claim 13 wherein said false bottom comprises a surface and a lip extending from said surface toward said oven chamber floor.

15. A method of assembling a hidden bake oven including an oven chamber and a bake element within the oven chamber, said method comprising the step of installing a removable false bottom inside the oven chamber so that the false bottom covers the bake element.

16. A method in accordance with claim 15 wherein the oven chamber includes an oven chamber floor, the false bottom covering the chamber floor.

17. A method in accordance with claim 15 wherein installing the removable false bottom comprises sliding the false bottom into the oven chamber between the oven sidewalls.

18. A method in accordance with claim 1 wherein installing the removable false bottom comprises the steps of:

inserting the removable false bottom into the oven chamber; and positioning the removable false bottom until the removable false bottom covers the bake element.

19. A method in accordance with claim 18 wherein the oven chamber includes an oven chamber floor, and positioning the removable false bottom further comprises substantially covering the oven chamber floor.

20. A method in accordance with claim 19 further comprising the step of fastening the removable false bottom to the oven chamber.

* * * * *